United States Patent [19]

Theurer et al.

[11] 4,091,739

[45] May 30, 1978

[54] RESILIENT SINGLE AXLE TRUCK

[75] Inventors: Josef Theurer; Klaus Riessberger, both of Vienna, Austria

[73] Assignee: Franz Plasser Bahnbaumaschinen-Industriegesellschaft M.B.H., Vienna, Austria

[21] Appl. No.: 623,589

[22] Filed: Oct. 20, 1975

[30] Foreign Application Priority Data

Dec. 6, 1974 Austria ..... 9791/74

[51] Int. Cl.[2] ..... B61F 3/00; B61F 5/24; B61F 5/36; B61F 5/50

[52] U.S. Cl. ..... 105/224 R; 105/165; 105/199 S; 105/453

[58] Field of Search ..... 105/157 R, 182 R, 224 R, 105/165, 199 S, 453

[56] References Cited

U.S. PATENT DOCUMENTS

| | | | |
|---|---|---|---|
| 2,941,482 | 6/1960 | Furrer | 105/182 R X |
| 3,062,328 | 11/1962 | Butler et al. | 105/224 R X |
| 3,682,102 | 8/1972 | Pocklington | 105/157 R |

OTHER PUBLICATIONS

McGraw-Hill Encyclopedia of Science and Technology; 1971; Shock Absorber, vol. XII, pp. 336–339 inc, Johnson; Mechanical Spring, vol. XIII, pp. 14–17 inc, Linderoth, Jr.; Vibration Isolation, vol. XIV, pp. 361–369 inc, Johnson

*Primary Examiner*—Drayton E. Hoffman
*Assistant Examiner*—Howard Beltran
*Attorney, Agent, or Firm*—Kurt Kelman

[57] ABSTRACT

An undercarriage comprises a bogie frame, a bearing for each end of the wheel axle, and at least two coil springs and at least one hydraulic shock absorber mounted between the bogie frame and each axle bearing for damping movement between the bogie frame and the axle bearings in all three spatial directions.

4 Claims, 7 Drawing Figures

RESILIENT SINGLE AXLE TRUCK

The present invention relates to improvements in an undercarriage for mounting a vehicle with wheels for mobility on a track, which comprises an undercarriage bogie frame, an axle carrying the vehicle wheels, a bearing for each end of the axle, and resiliently yielding means mounted between the bogie frame and axle bearings for damping movement between the bogie frame and the axle bearings in all three spatial directions. The improved undercarriage of this invention is particularly useful for mobile track maintenance machines with two or more axles.

Wheeled vehicles require special means to assure their quiet and smooth operation. In the case of mobile track maintenance machines, such as track tamping, leveling and lining apparatus as well as ballast treating and cleaning machines, this requirement is particularly difficult to meet because such vehicles generally have a very uneven mass distribution, due to the varied arrangement of track working tools on the chassis. Many track maintenance machines designed to work on the ballast and/or the track desirably use as much of the space below the machine frame for working tools as possible. Therefore, relatively long undercarriages using leaf springs and the like are undesirable because they take away valuable space for mounting the working tools and it is, therefore, advantageous for the undercarriages of such mobile track maintenance machines to be as short as possible. Furthermore, the different types of track maintenance machines have quite different working tool arrangements, due to the considerable differences in their functions, which leads to totally different, but always uneven, distributions of mass in different machine types. Therefore, use of the same undercarriage produces quite different results in these different machine types. Therefore, experiences gained with undercarriages of freight cars, for instance, cannot be applied to track maintenance machines. The difficulties are further increased with single-axle undercarriages because they permit less load tolerances than swivel trucks, for instance.

Smooth running of such track maintenance machines on the track can be assured only if the relative movement between the undercarriage bogie frame and the axle bearings is damped in all three spatial directions, i.e. in the vertical direction of load absorption, in the horizontal direction of track elongation in which the machine moves and is subjected to braking force, and in the transverse horizontal direction in which the axle bearing forces operate. However, the requirements for a smooth running of the vehicles are contradicted by the simultaneous desire for maximum vehicle speeds.

Metal-rubber shock absorption systems have been very widely used in undercarriages for mounting a vehicle with wheels for mobility on a track. However, despite uniform manufacturing procedures, the parameters of such systems in respect of their resiliency characteristics differ from each other, the frequency-dependent dynamic behavior of such springs being difficult to determine and, therefore, remaining largely out of calculation. The stiffness of these springs under the influence of dynamic loads and because of non-uniformity of their materials deviates considerably from actually observed values so that it is impossible to calculate the same beforehand. Therefore, undercarriages equipped with these shock absorption systems, particularly single-axle undercarriages, show insufficient damping when used in mobile track maintenance machines. Various proposals have, therefore, been made to provide shock absorption constructions which meet at least minimum damping requirements in these types of machines. All these efforts have, however, failed to give satisfactory results.

It is accordingly a primary object of the invention to provide an undercarriage of the indicated type for mounting a vehicle with wheels for mobility on a track, which is useful and effective for different types of mobile track maintenance machines having different damping and shock absorption requirements, and which provides a smooth ride even at relatively high speeds of 80 to 100 km/h.

This and other objects have been surprisingly simply accomplished in accordance with the present invention by mounting at least two coil springs and at least one hydraulic shock absorber between the bogie frame and each axle bearing for damping movement between the bogie frame and axle bearings in all three spatial directions.

This simple combination of resiliently yielding means makes possible, on the one hand, adaptation of the undercarriage to different types of vehicles with quite different running characteristics, due to the possible selection of the spring characteristics of the coil spring elements, while, on the other hand, considerably improving the running quality of such track maintenance machines above values not heretofore obtainable. Furthermore, this construction is exceedingly simple and requires little space, and it gives highly satisfactory running quality in singleaxle undercarriages, too, even at such high speeds as 100 km/h and more, without suffering from the unfavorable effects of uneven mass distribution. The combination of these different, at least partially known shock absorption elements makes it possible effectively to control different types of uneven mass distributions on wheeled vehicles running on tracks. Another advantage resides in the exchangeability of different shock absorption elements with different characteristics of resiliency to obtain the desired shock absorption.

The above and other objects, advantages and features of this invention will become more apparent from the following detailed description of certain now preferred embodiments thereof, taken in conjunction with the accompanying drawing wherein FIG. 1 shows a side elevational view, partly in section of an embodiment of this invention with brake shoes, FIG. 2 is a front elevational view of the undercarriage shown in FIG. 1, portions at the left track rail being illustrated in section along line A—A of FIG. 1 while portions at the right rail are shown in section along line B—B of FIG. 1.

Figure 1:
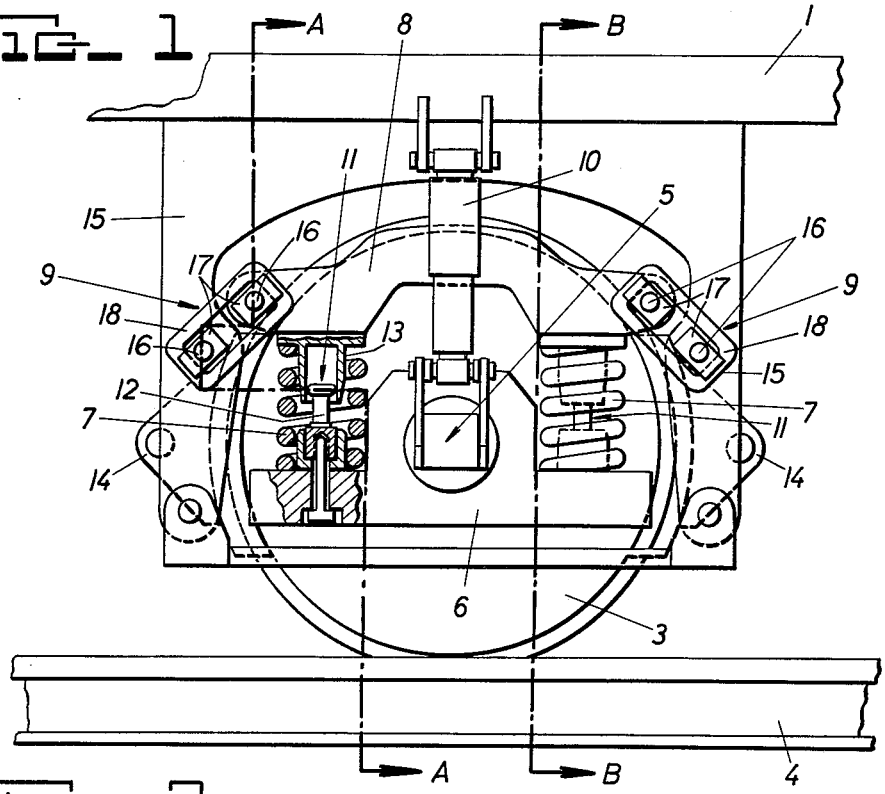
Figure 2:
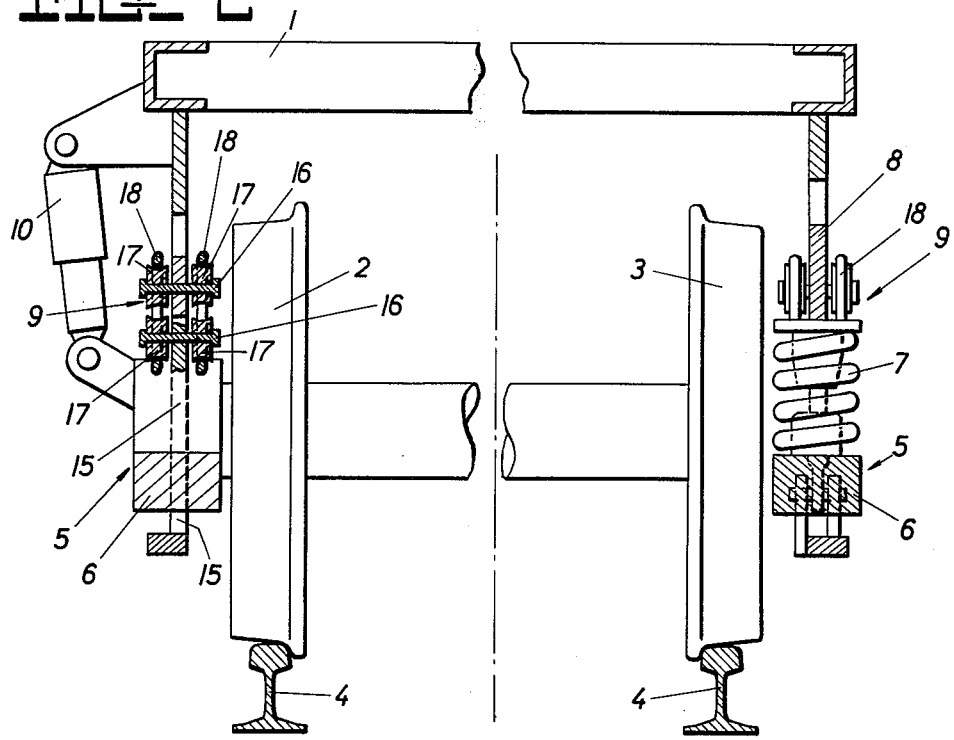

Referring now to the drawing and first to FIGS. 1 and 2, the undercarriage for mounting a vehicle with wheels for mobility on a track comprises undercarriage bogie frame 1 and an axle carrying vehicle wheels 2, 3 moving on rails 4, 4. Each end of the wheel axle is held in bearing 5 mounted in T-shaped casing 6. The wheels are resiliently yieldingly connected with bogie frame 1 by means of a pair of coil springs 7, one end of the coil springs being supported on the laterally projecting parts of the T-shaped bearing casing. The springs are aligned with the axle bearing in the direction of track elongation and are arranged symmetrically in respect of the axle bearing. The other ends of the coil springs are supported by, and press against, yoke-like spring shield 8 mounted in vertical alignment with bearing casing 6. Link suspension 9 links the spring shield to undercarriage bogie frame 1.

Relative movement between the bogie frame and the bearing casing is further damped by hydraulic shock absorber 10 centered between the pair of coil springs 7, 7 and, as shown in FIG. 2, linked to bogies frame 1 and axle bearing 5, respectively. The embodiment of FIG. 1 provides brake shoes for the vehicle wheels of which cheek plates 14, 14 are shown and, in this embodiment, the hydraulic shock absorber is pivoted to the cover of bearing casing 6 and the defending bogie frame 15.

Mounting the coil springs between a pivotal shield and the bearing casing has the advantage of permitting the coil springs to damp the combined vertical and longitudinal mobility obtained by the link chain suspension of the shield. At the same time, the springs are subjected to less stress because the movements of the bogie frame supporting an uneven distribution of mass cause a constantly increasing load on the springs rather than sudden impacts thereon.

The illustrated symmetrical arrangement of the coil springs and hydraulic shock absorber provides a particularly effective and simple construction for single-axle undercarriages.

As shown in the drawing, the illustrated preferred embodiment comprises vertical guide 11 for each of coil springs 7. The vertical guide extends axially within the springs and improves the positioning of the wheels and reduces lateral and longitudinal movements thereof. This guide also further damps the resiliency of the arrangement. In the illustrated embodiment, vertical guide 11 consists of two telescoping guide parts, i.e. mushroom-shaped element 12 mounted on the axle bearing and sleeve-shaped element 13 mounted on spring shield 8, element 12 being glidingly received in element 13. Thus, depending on the degree of compression of the coil spring, the telescoping guide parts 12, 13 move vertically in relation to each other. The rounded head of mushroom-shaped element 12 permits relative movement between the two guide parts in a direction longitudinal and transverse to the direction of track elongation. In this way, the wheels may move relative to shield 8 to make use of the flexi-coil effect of coil spring 7 while limiting excess relative movements and assuring a very advantageous distribution of the relative movement over springs 7, shield 8 and suspension 9.

This specific arrangement is very advantageous if such single-axle undercarriages are used, for instance, as two undercarriages of a track maintenance machine because it enables the desired shock absorption characteristics to be adapted according to specific requirements of the machine and prevents the machine from undue swaying in curves, for instance, which may be caused by asymetrical arrangements of parts.

To prevent the wheel assembly from falling out of the bogie frame and the shock absorption mechanism from being damaged during loading or transport of the machine, laterally depending bogie parts 15 arranged adjacent wheels 2, 3 are strapped together. Bolts or like readily removable strapping elements may be used for this purpose to facilitate ready assembly or disassembling of the wheels and the undercarriage bogie frame.

As appears most clearly from the sectional showing of link suspension 9 at wheel 2 in FIG. 2, the suspension comprises spring bolts 16, 16 respectively inserted into a bore in bogie frame part 15 and in spring shield 8. If desired, welding bushes may be used for mounting the bolts on frame part as bracket 15 and shield 8. The bolts project from bracket 15 and shield 8 on both sides thereof and the projecting bolt portions carry a pair of link supports 17. Each pair of link supports on respective sides of bracket 15 and shield 8 receives a spring link 18 so that spring shield 8 is yieldingly connected to, or suspended on, U-shaped bogie frame part 15. The spring bolts have heads so as to prevent link supports 17 from becoming detached. Movement of the spring links transversely to the track elongation is assured by a suitable dimensioning of the parts. Furthermore, spring links 18 may revolve around spring bolts 16.

Figure 3:
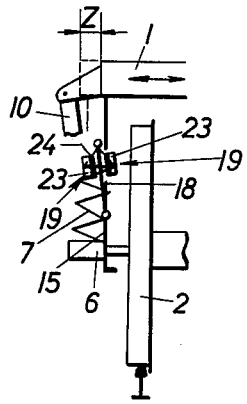
FIGS. 3 to 5 are schematic illustrations showing the relative movements of the shock absorption elements between the undercarriage bogie frame and the axle bearings in all three spatial directions.
Figure 4:
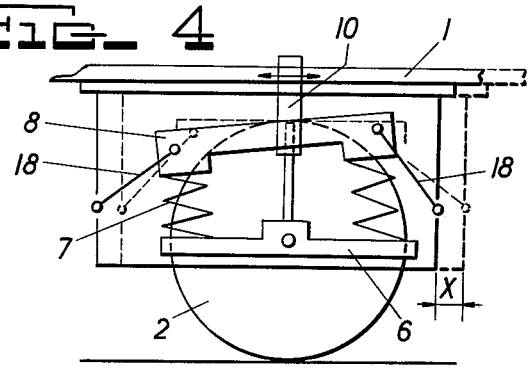
Figure 5:
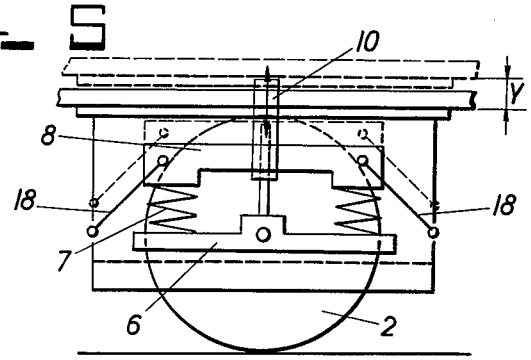

The operation and effect of the undercarriage will be partially obvious from the above description of its construction and will be further elucidated in connection with the schematic illustrations in FIGS. 3 to 5.

As shown in FIG. 3, in case of misalignments in the track, the undercarriage bogie frame 1 will be oscillated transversely to the track in relation to wheel 2, i.e. laterally by distance $z$. This will cause links 18 to assume an oblique position in relation to bogie frame part 15 as well as spring shield 8. Coil springs 7 will also be obliquely positioned, i.e. flexed. Essentially, half of the lateral movement will be absorbed by spring links 18 and half by coil springs 7 because vertical guides 11 prevent the entire lateral movement from being absorbed by the coil springs. This reduces wear on the coil springs and still assures damping of the lateral movement and exerts a return force on spring shield 8 in conjunction with hydraulic shock absorber 10.

As will be more fully shown and described in connection with the embodiment of FIG. 6, friction-reducing damping elements 19 mounted on torsion rods, for instance elastic stops, may be mounted in the region of link suspensions 9 to avoid excess lateral movements of spring links 18, due to large masses mounted on the machine in the region of the undercarriage, particularly in the case of short impacts.

Operating conditions occurring, for instance, at the start and/or braking of the vehicle, are illustrated in FIG. 4. In case of acceleration or deceleration of the machine, bogie frame 1 moves longitudinally of the track in relation to wheel 2 by distance $x$. In this case, the spring shield 8 is pivoted into a position oblique to that of the track plane since spring links 18 will revolve about spring bolts 16. This oblique positioning of the spring shield will cause one of the coil springs 7 to be loaded more strongly than the other spring. This differential loading of the coil springs causes not only damping of the movement but also exerts a return force on the spring shield to force it back into its rest position parallel to the track plane.

When, as shown in FIG. 5, bogie frame 1 moves vertically in relation to the track plane and wheel 2 by distance $y$, such a relative movement is damped essentially by hydraulic shock absorber 10 and compression of coil springs 7, 7. At the same time, the compressed coil springs will tend to return the bogie frame to its rest position.

It will be understood that the relative movements in all three spatial directions often occur simultaneously during the movement of the vehicle along the track and that the shock absorption system accordingly operates at the same time in all directions to damp the relative movements in the manner hereinabove described.

Figure 6:
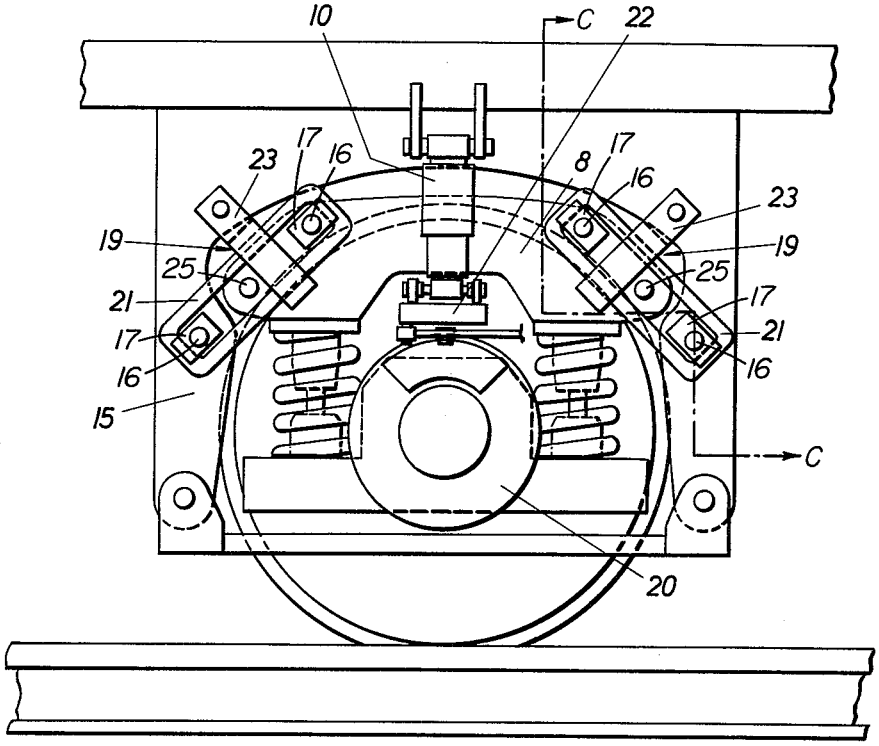
FIG. 6 is a side elevational view of another embodiment of an undercarriage with disc brakes.

To avoid redundancy in the description of the embodiment of FIG. 6, like reference numerals have been used herein for like parts operating in a like manner, this embodiment differing from that of FIGS. 1 and 2 essentially only by the use of a disc brake of which there is shown cover 20, instead of brake shoes, and the connection of bogie frame part 15 to spring shield 8 by means of elongated spring links 21 instead of short links 18.

In this embodiment, the axle bearing casing has affixed thereto support plate 22 for the disc brake and hydraulic shock absorber 10 is pivoted to the support plate to permit free access to the disc brake, particularly when it is desired to change the shoes of the brake.

Figure 7:
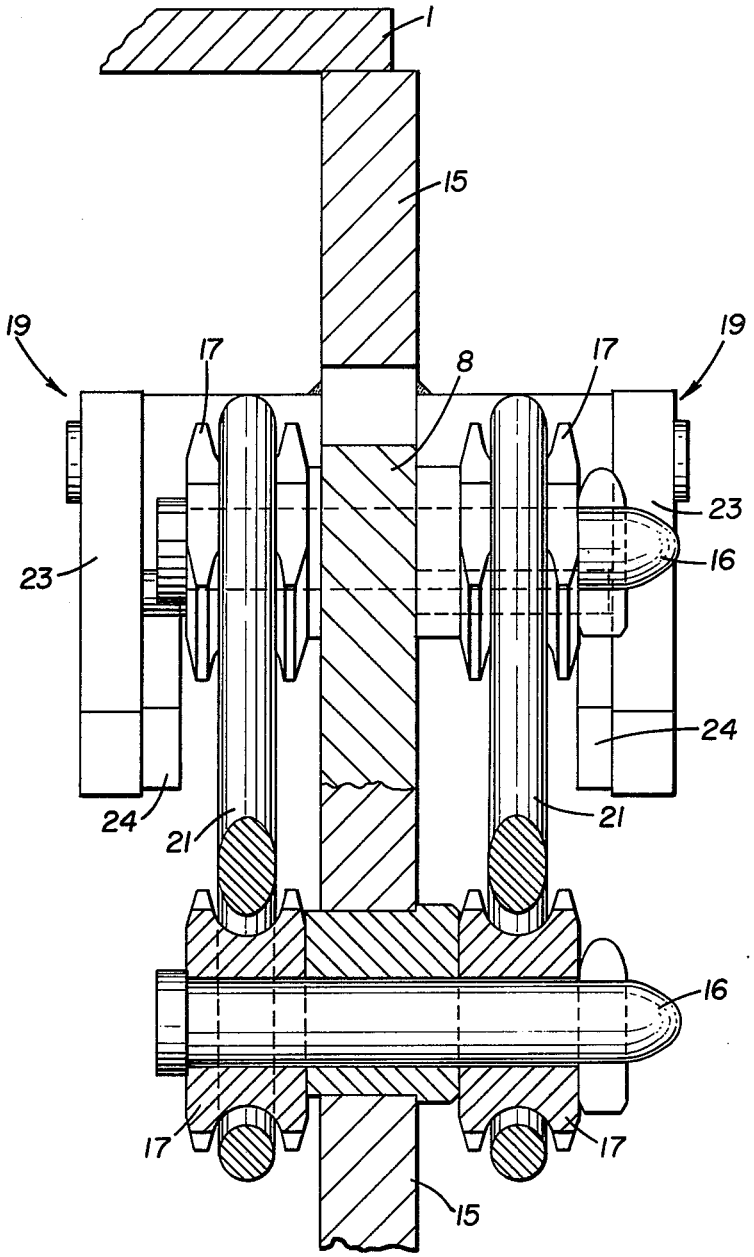
FIG. 7 is an enlarged section of FIG. 6 along line C—C.

Also, as has been mentioned in connection with FIG. 3 and is shown in detail in FIG. 7, elastic stops 19 are mounted laterally adjacent spring links 18 to damp the flexing of the links in a transverse direction and to limit such movement of the elongated links. These stops are shown to consist of torsion rod 23 affixed at one end to frame part 15 and carrying blocks 24 of elastic material at the opposite, free end of the torsion rod.

As is also shown in FIG. 6, the spring shield defines two bores for the selective insertion therein of different link suspensions so that the spring shield and the bogie frame may be selectively interconnected by short links 18 or elongated links 21, depending on operational requirements bore 25 being provided for attachment of a short link. Obviously, more than two such bores may be provided in the spring shield for receiving the spring bolts of the link suspensions.

While the undercarriage bogie frame receiving the wheel assembly has been illustrated herein as a fixed part of the vehicle frame, it will be obvious that it may form part of a swivel truck undercarriage. In this case, two or more wheel assemblies may be mounted on the swivel truck frame by means of the herein described shock absorption system while the swivel truck is then mounted on the vehicle frame in a conventional manner.

Also, the damping action of the hydraulic shock absorber 10 could be enhanced, if desired, by constituting vertical guides 11 as hydraulic shock absorbers, or such hydraulic shock absorbers serving as vertical guides for the coil springs may replace shock absorber 10 and thus constitute the hydraulic shock absorber means in the described combination.

Special operating conditions may be encountered due to the distribution of the mass on different types of mobile track maintenance machines, and to meet all official requirements and regulations in respect of vehicle shock absorption, it is possible within the scope of the present invention not only to use short or long suspension links but also to use double suspensions between the spring shields and the bogie frame. Furthermore, elongated suspension links 21, preferably with associated elastic stops 19, may be used to suspend one wheel assembly of the vehicle on spring shields 8 while the second wheel assembly is suspended by short suspension links 18.

In view of increased vehicle speeds of track maintenance machines during recent years, several regulatory agencies for railroads have required improved standards for smooth riding and prevention of derailments. This includes, for instance, mobile ballast leveling machines which run on single-axle undercarriages and are subject to considerable vibrations and shocks during operation. Extensive experiments have shown that the shock absorption system of this invention which combines coil springs and hydraulic shock absorbers, produces excellent results with coil springs which have a resiliency enabling them to yield about 40 to 70 mm, preferably about 60 mm, under an axle load of about 2,500 to 3,000 kp per spring, and hydraulic shock absorbers having an adjusting power of at least 400 to 600, preferably 550 kp, for a stroke speed of 10 cm/sec.

Regulatory agencies for railroads have elaborated acceptable values based on extensive investigations of the human sensitivity to vibrations and shocks. The corresponding value numbers are determined from the average horizontal and vertical acceleration values and the vibration frequencies of the vehicle during a run on the track. The extreme value is considered to be 5% which has been determined from the average acceleration values in gram of 5% of the largest vibration peaks experiences over a measuring distance of, say, 1 km. This value must not exceed the number 4.25 according to the regulations of some railroad regulating agencies. With the single-axle undercarriages of the present invention, value numbers as low as 3.60 were experienced, which equals almost the shock absorption quality of sleeping cars. This despite the fact that the shock absorption had to damp also the longitudinal movements encountered during the stepwise advance of the machine along the track.

Obviously, the characteristics of the coil springs and the hydraulic shock absorbers will be selected according to their use for different types of mobile track working machines, such as ballast plows, tampers, ballast cleaning machines, etc., depending primarily on the differences in the distribution of mass in such machines. For instance, hydraulic shock absorbers with an adjusting power of 650 to 1,450 kp for a stroke speed of 10 cm/second and coil springs with a resiliency enabling them to yield about 38 mm under a load of 2,500 kp may be useful. Under all circumstances, the combination of the present invention makes it possible exactly to calcualte the shock absorption of its individual parts as well as of their combined action, and thus to adapt the system readily to different mass distribution conditions.

What is claimed is:

1. In an undercarriage for mounting a track maintenance vehicle with wheels for mobility on a track, which comprises an undercarriage bogie frame, an axle carrying the vehicle wheels, a bearing for each end of the axle, resiliently yielding means mounted between the bogie frame and each axle bearing, the resiliently yielding means including at least two coil springs and at least one hydraulic shock absorber for damping movement between the bogie frame and axle bearings in all spatial directions, a yoke-like spring shield for the coil springs associated with each axle bearing, a link suspension linking each of the spring shields to the undercarriage bogie frame, an elastic stop mounted on the bogie frame laterally adjacent each of the link suspensions to limit movement of each of the link suspensions in a transverse direction, each elastic stop comprising a torsion rod having one end affixed to the bogie frame and a free end opposite to the one end, the free end carrying a block of elastic material and a casing for each axle bearing, the coil springs being mounted between the spring shields and the bearing casings, and the hydraulic shock absorber being mounted between the bogie frame and the bearing casings.

2. In the undercarriage of claim 1, each spring shield defining a plurality of bores for the selective insertion therein of different link suspensions.

3. In the undercarriage of claim 1, wherein a pair of the coil springs is aligned with the axle bearing in the direction of track elongation, the coil springs being arranged symmetrically in respect of the axle bearing, and the hydraulic shock absorber is centered between the pair of coil springs and is linked to the bogie frame and to the axle bearing, respectively.

4. In the undercarriage of claim 1, a vertical guide consisting of two telescoping guide parts for each of the coil springs and extending axially within the springs, one of the guide parts being mounted on the axle bearing and the other guide part being mounted on the undercarriage bogie frame, one guide part being a mushroom-shaped element and the other guide part being a sleeve-shaped element telescopingly receiving the mushroom-shaped element.

* * * * *